US011373515B2

(12) United States Patent
Carrieri et al.

(10) Patent No.: US 11,373,515 B2
(45) Date of Patent: Jun. 28, 2022

(54) FAST INSTALL SELF-SUPERVISING FIRE COMMUNICATOR

(71) Applicant: Napco Security Technologies, Inc., Amityville, NY (US)

(72) Inventors: Michael A. Carrieri, Amitiville, NY (US); Thomas F. Karl, Amityville, NY (US); Lance S. Lindsay, Amityville, NY (US)

(73) Assignee: Napco Security Technologies, Inc., Amityville, NY (US)

( * ) Notice: Subject to any disclaimer, the term of this patent is extended or adjusted under 35 U.S.C. 154(b) by 0 days.

(21) Appl. No.: 17/216,202

(22) Filed: Mar. 29, 2021

(65) Prior Publication Data

US 2021/0217297 A1 Jul. 15, 2021

Related U.S. Application Data

(63) Continuation of application No. 16/370,867, filed on Mar. 29, 2019, now abandoned.

(51) Int. Cl.
*G08B 29/18* (2006.01)
*G08B 17/00* (2006.01)

(52) U.S. Cl.
CPC ..... *G08B 29/18* (2013.01); *G08B 17/00* (2013.01)

(58) Field of Classification Search
CPC ..... G08B 17/00; G08B 25/14; G08B 29/06; G08B 29/18
See application file for complete search history.

(56) References Cited

U.S. PATENT DOCUMENTS 4,465,904 A 8/1984 Gottsegen
5,950,150 A * 9/1999 Lloyd ..... A62C 37/50 702/183
6,078,050 A 6/2000 Castleman
9,875,644 B2 1/2018 Chiarizio

* cited by examiner

*Primary Examiner* — Nader Bolourchi
(74) *Attorney, Agent, or Firm* — Keith A. Vogt; Keith Vogt, Ltd.

(57) ABSTRACT

A fire alarm communication device having a first and second output voltage which are constant during normal operation of the fire alarm communicator. During a trouble condition of the fire alarm communicator, one of the output voltages is manipulated

17 Claims, 3 Drawing Sheets

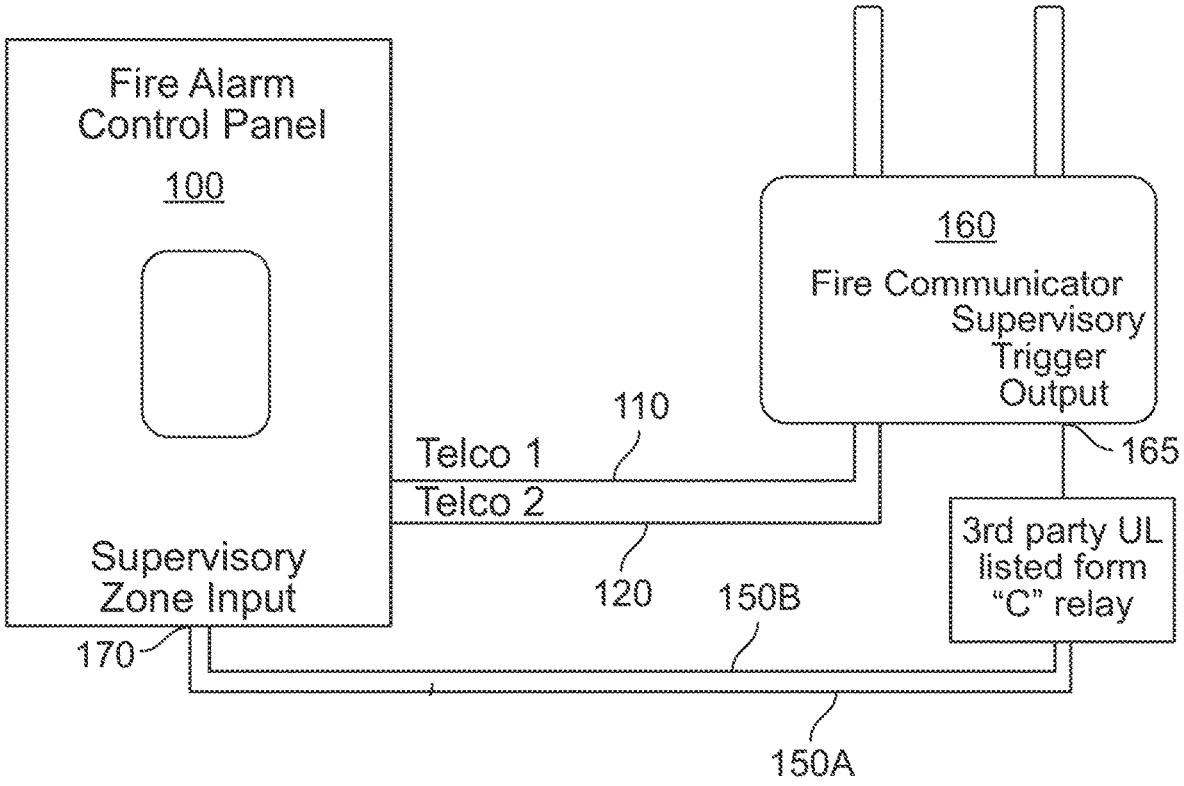
PRIOR ART FIG. 1
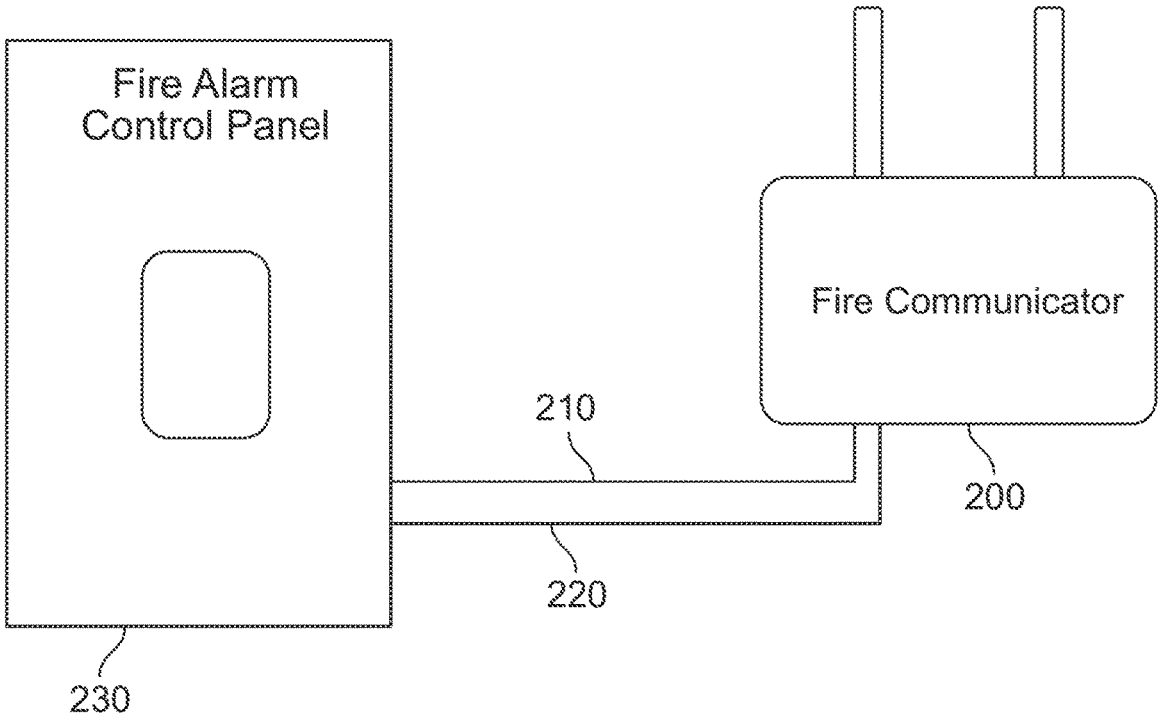
FIG. 2A

FAST INSTALL SELF-SUPERVISING FIRE COMMUNICATOR

RELATED APPLICATIONS

This application is a continuation of U.S. Ser. No. 16/370,867 filed on Mar. 29, 2019, which is incorporated herein in its entirety.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

As shown in FIG. 1, commercial fire alarm control panels (FACP) 100 typically communicate emergency signals including fire alarms, system troubles and supervisory conditions to the monitoring central station through two traditional dedicated telephone lines 110 and 120. For redundancy, two telephone lines are always required, a primary telephone line 110 and a secondary telephone line 120 connected to the FACP 100. The voltage of the telephone lines is constantly monitored by the FACP to ensure they are present and in good working order.

In recent years, there has been a transition to alternative fire alarm communication devices due to the discontinuation of traditional copper telephone lines 110 and 120. The alternative fire alarm communication devices 160 may include cellular radio and/or IP or other methods of communication that are used to transmit alarm events to the central station. In many cases, the alternative fire alarm communication device 160 will connect to the telephone jacks of the FACP 100, in effect, replacing the outdated telephone lines 110 and 120.

However, when retrofitting an existing telephone line based FACP 100 with a non-telephone-based fire alarm communicator 160, traditional telephone lines 110 or 120 are inactivated. The inactivation creates a situation where the FACP will receive phantom inoperable communication line signals thereby putting the FACP in a constant state of system trouble and rendering the system useless. To resolve this problem, prior art fire alarm communicator 160 developed a work-around by being designed to always provide FACP 100 with a constant voltage emulating an operational telephone line. However, providing a constant voltage to the FACP over lines 110 and 120 renders the lines inoperable as potential supervisory lines for the fire alarm communicator itself to communicate trouble events to the FACP.

As shown in FIG. 1, the prior art solution to the lack of supervision of the communicator was to establish an additional trouble output lines 150A and 150B on the alternative fire alarm communication device 160 to supervision input 170 on FACP 100. This additional line of communication satisfied the need for an additional level of supervision by FACP 100 of fire alarm communicator 160. This input is typically programmed as a supervisory zone/point on the FACP that will allow the FACP to audibly annunciate any alternative fire alarm communication device trouble conditions. This alternative fire alarm communication device trouble annunciation requires an audible notification on the local annunciator of the system.

As an example, when fire alarm communicator 160 is a radio, upon detection of radio trouble, the radio will bring the supervisory trigger output 165 low, causing a fault on FACP providers to rezone input 170. This will cause FACP 100 to locally annunciate the trouble, alerting occupants of the fire system trouble.

Establishing this supervision method requiring an extra line on an existing FACP presents several challenges to the fire alarm service personnel, including the following:

1. A separate wire run from the fire alarm communicator such as radio to trigger a zone on the fire panel must be created. However, it is difficult to connect the wire back to the FACP, to find a free zone, and to program the panel to accept the supervisory zone.
2. If the FACP does not support zone expansion, it is not possible to properly supervise the communication device.
3. In many cases, there will not be an available point/zone on the FACP that can be used as a supervision zone. If the fire alarm control panel supports zone expansion, this will require the installation of additional hardware to accept the supervision connection.
4. Once an available point/zone that can be used as a supervision zone has been established, the FACP must be reprogrammed to support and properly annunciate the required supervision events.
5. If the fire alarm service personnel are not proficient in the programming of a particular brand of FACP, they must learn it in order to perform the required programming.

The above requirements present challenges to the fire alarm service personnel tasked with connecting the alternative fire alarm communication device to the FACP.

BRIEF SUMMARY OF THE INVENTION

In one embodiment, the present invention provides a system and method of FACP supervision of an alternative fire alarm communication device that does not require the physical connection of a supervisory point to a FACP and does not require any special programming of the fire alarm control panel.

In another embodiment, the present invention provides a system and method that allows an alternative fire alarm communication device to be connected to a FACP to indicate an alternative fire alarm communication device system trouble to the FACP through manipulation of the telephone line voltage emulation. This manipulation of the telephone line voltage emulation will cause a communication-related system trouble to annunciate at the annunciator or keypad of the fire alarm system, which is typically installed in the lobby or entryway of the building, alerting occupants of the system trouble.

In another embodiment, the present invention provides a system and method that allow for the manipulation of the voltage of one of the two emulated telephone lines to communicate detected system trouble to the FACP, while keeping the second of the two telephone lines to be available for emergency communication.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

FIG. 1 illustrates a traditional method of fire alarm communicator supervision.

FIG. 2A illustrates a preferred embodiment of the present invention.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 2B:
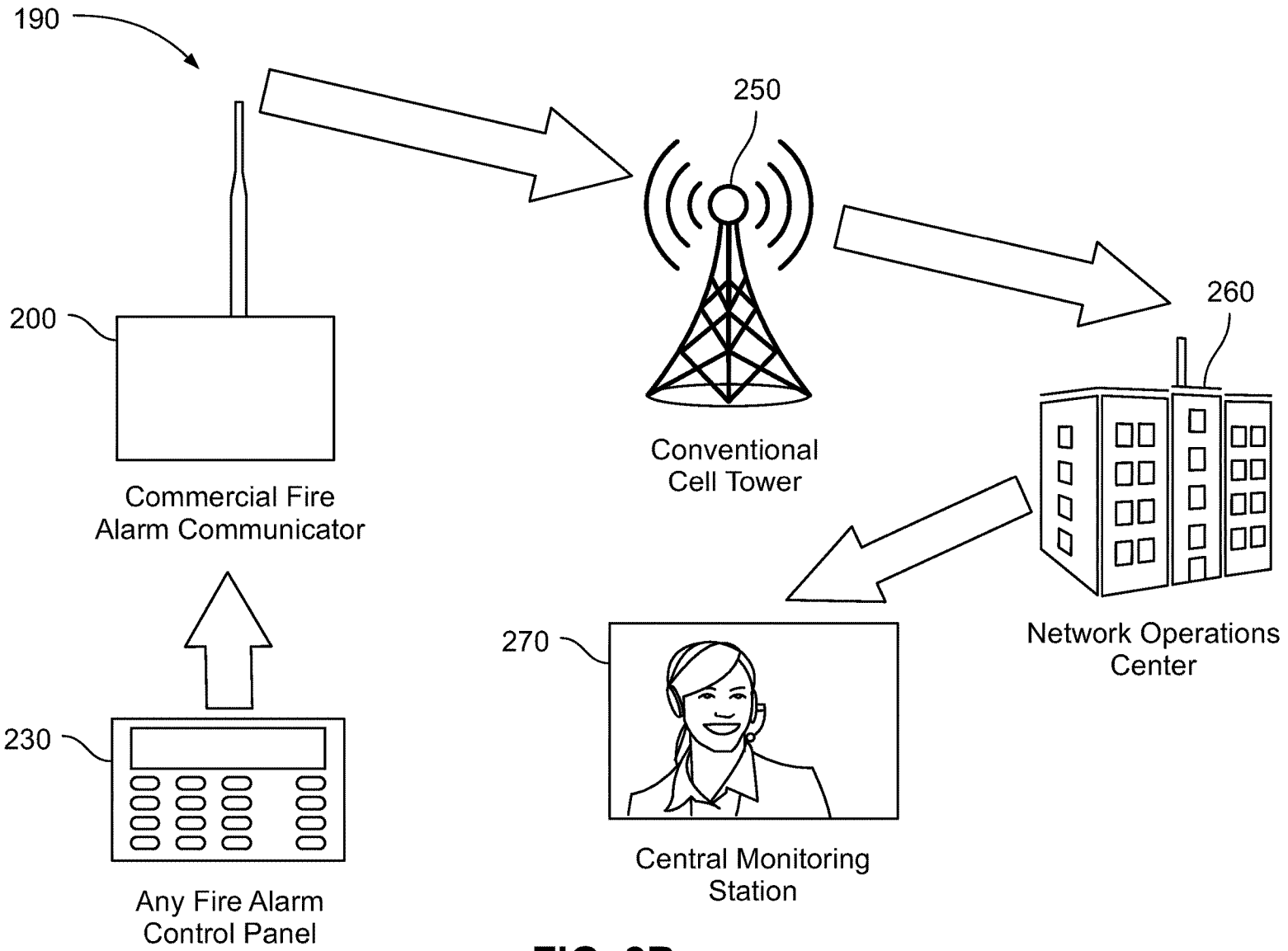
FIG. 2B illustrates a system wide application of the embodiment shown in FIG. 2A.

In a preferred embodiment, as shown in FIGS. 2A and 21B, the present invention provides fire alarm system 190 that includes a fire alarm communicator 200 and an FACP 230. The system may be configured to communicate with cell tower 250 which is in communication with a central station or network operations center 260 and central monitoring station 270.

Fire alarm communicator 200 includes two output lines 210 and 220. As with prior art systems, output lines 210 and 220 are configured to provide a constant output that is recognized by FACP 230 as a signal or voltage that is indicative of an operational telephone line which usually has a voltage below 48 volts DC or a range below 48 volts DC. However, unlike prior art fire alarm communicators, no separate supervisory line is established between fire alarm communicator 200 and FACP 230, thereby, doing away with one or both of lines 150A and 150B.

Instead, the embodiments of the present invention turn the perceived disadvantage of supplying the FACP with a constant voltage to avoid triggering a system trouble event based on a perceived inoperable telephone line at the FACP into an advantage. The present invention is configured to annunciate a trouble condition of fire alarm communicator 200 by removing or manipulating the constant output found on lines 210 and 220, rather than keeping it at a constant output as the prior systems are designed to do. This manipulation of the voltage will cause a communication-related system trouble to annunciate at the annunciator or keypad of FACP which is typically installed in the lobby or entryway of the building, alerting trouble or disturbance of the system to occupants of the system. In essence, the embodiments of the present invention are configured to have a fire alarm communicator 200 system trouble condition simulate an operational failure of a traditional telephone line thereby causing FACP 230 to go into an alarm state. This voltage manipulation allows for supervisory events concerning fire alarm communicator 200 to be communicated through pre-existing telephone line inputs at the FACP eliminating the need for additional communication lines.

Figure 3:
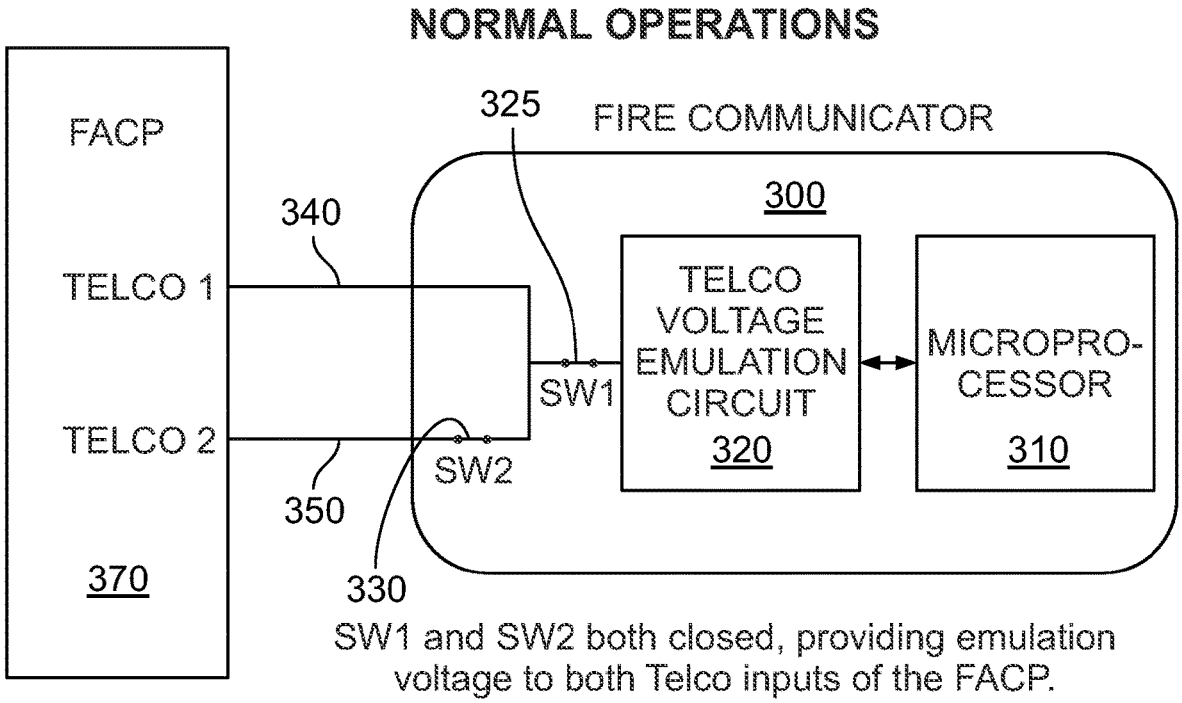
FIG. 3 illustrates the embodiment shown in FIG. 2A during normal operations.
Figure 4:
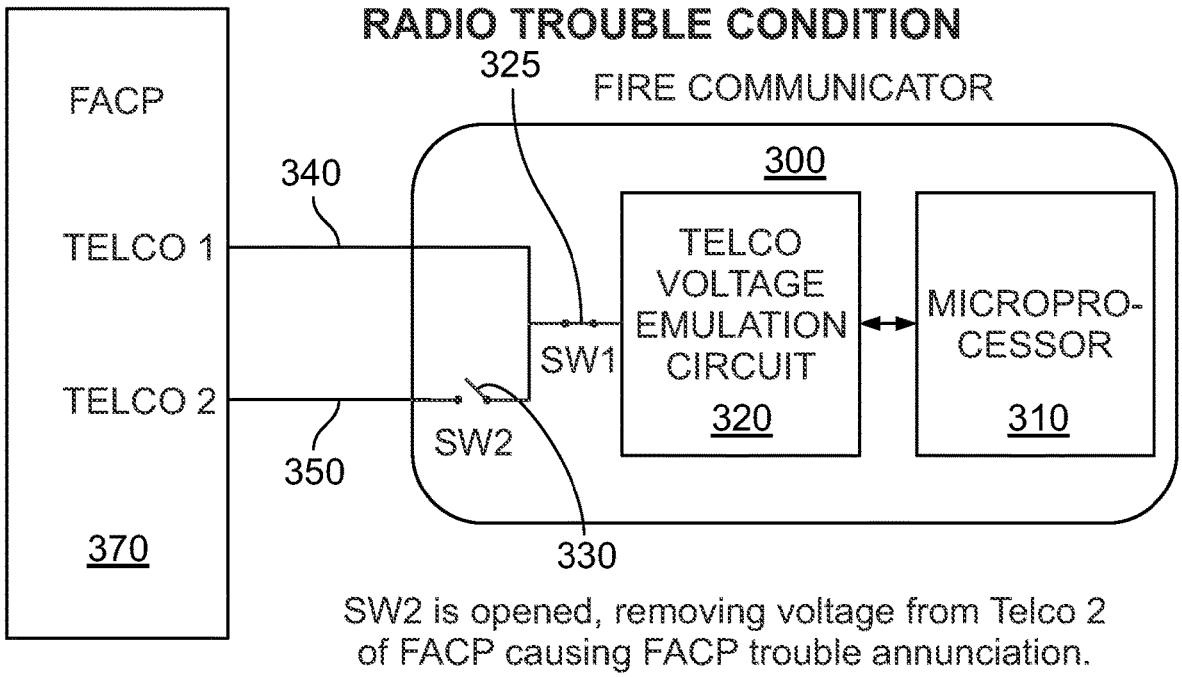
FIG. 4 illustrates the embodiment shown in FIG. 2A during a system trouble condition.

FIGS. 3 and 4 show an alternate embodiment of the present invention comprised of fire alarm communicator 300 which may be a radio that includes microprocessor 310 and voltage control circuit 320. Also provided are switches 325 and 330 as well as outputs 340 and 350. As shown in FIG. 3, during normal operation of fire alarm communicator 300, switches 325 and 330 are closed and outputs 340 and 350 are at constant voltage which is supplied to FACP 300. As shown in FIG. 4, when a radio system trouble condition is detected by microprocessor 310, the voltage of either outputs 340 and 350, or both, are manipulated which may be in the form of sufficiently lowering the voltage to cause FACP 370 to detect what is perceived as a telephone line failure or eliminating the voltage altogether Persons of skill in the art would recognize that the voltage of outputs 340 and 350 may be manipulated in a number of ways such as by opening switch 325 or opening switches 325 and 330. Alternately, only switch 330 may be opened. Also, microprocessor 310 and voltage control circuit 320 may be configured to lower the voltage or cease supplying power to one or both of the outputs without the use of switches. Although more expensive, separate voltage emulation circuits can be used for outputs 340 and 350.

In another embodiment of the present invention, outputs 340 and 350 are independently connected to the Telco Voltage Emulation Circuit 320, and switches 325 and 350 respectively connect to outputs 340 and 350.

Common supervisory events that will cause a FACP system trouble annunciation include radio trouble conditions such as (1) Communicator Fail to Check-In (communicator failed to check-in in the prescribed time period, i.e.: every 5 minutes), (2) Cellular Network Trouble (communicator is unable to establish contact with the cellular tower), (3) Communicate Failure (the communicator was unable to successfully report to the central station), (4) Communicator Low Voltage (the communicator voltage is low, i.e.: brown-out), and (5) Communicator Low Battery (the communicator battery is low). In other embodiments of the present invention, each supervisory event may have its own predetermined signal.

In another embodiment, the present invention replaces the above supervisory standard for a fire alarm communicator requiring a separate line of communication with the FACP with a method that forces the radio to remove the telephone line voltage from the fire panel telco jack. This forces the fire panel to annunciate the trouble due to a perceived loss of an operable telephone line, a trouble event that all FACPs communicate with a central station over telephone lines are capable of doing regardless of make and model.

The present invention by using the existing FACP capabilities to sense an inoperable telephone line has many advantages over the prior art including (1) eliminating the need to establish a separate wire run from the radio to the fire panel; (2) having the ability to be used in cases where the FACP does not support zone expansion or where it is not possible to properly supervise the communication device; (3) eliminating the need to install additional hardware to accept the supervision connection even if the fire alarm control panel supports zone expansion; (4) eliminating the need for the FACP to be reprogrammed to support and properly annunciate the required supervision events; and (5) eliminates the need for fire alarm service personnel to be proficient in the programming of a particular brand of FACP.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above-described embodiments, methods, and examples, but by all embodiments and methods within the scope and spirit of the disclosure.

What is claimed is:

1. A method of installing a fire alarm communication device into a fire alarm control panel without adding any additional trouble output lines comprising the steps of:

installing the fire alarm communication device in the fire alarm control panel;

said fire alarm communication device having: 1) a first and a second output voltages; 2) a microprocessor and a voltage control circuit configured to create the first and second output voltage; and 3) at least one switch, said switch is closed during normal operation of the fire alarm communication device and open during a system trouble condition of the fire alarm communication device;

connecting said first output voltage to a preexisting first telephone line;

connecting said second output voltage to a preexisting second telephone line;

communicating a normal operation condition to the preexisting first and second telephone lines by having said microprocessor and said voltage control circuit supply a constant output voltage to the telephone lines; and communicating a trouble condition to the first and second telephone lines by having said microprocessor and said voltage control circuit alter one of the first and the second output voltages corresponding to one of the preexisting first and second telephone lines.

2. The method of claim 1 wherein output voltage is altered by lowering said output voltage to one of the preexisting first and second telephone lines.

3. The method of claim 1 wherein output voltage is altered by eliminating said output voltage to one of the telephone lines.

4. The method of claim 1 wherein output voltage is altered by lowering said output voltage to both of the telephone lines.

5. The method of claim 1 wherein output voltage is altered by eliminating said output voltage to both of the telephone lines.

6. The method of claim 2 wherein said trouble condition is communicated solely through at least one of the preexisting first and second telephone lines without adding any additional trouble output lines.

7. The method of claim 3 wherein said trouble condition is communicated solely through the telephone line without adding any additional trouble output lines.

8. The method of claim 4 wherein said trouble condition is communicated solely through both telephone lines without adding any additional trouble output lines.

9. The method of claim 5 wherein said trouble condition is communicated solely through both telephone lines without adding any additional trouble output lines.

10. The fire alarm communication device of claim 9 wherein said system trouble condition is a failure of the fire alarm communication device to check-in in a prescribed time period.

11. The fire alarm communication device of claim 9 wherein said system trouble condition is an inability of the fire alarm communication device to establish communication with a cellular tower.

12. The fire alarm communication device of claim 9 wherein said system trouble condition is an inability of the fire alarm communication device to report to a central station.

13. The fire alarm communication device of claim 9 wherein said system trouble condition is when the first and the second output voltages of the fire alarm communication device is below a predetermined level.

14. The fire alarm communication device of claim 9 further including a battery and said system trouble condition is when the voltage of said battery is below a predetermined level.

15. The fire alarm communication device of claim 9 wherein the fire alarm communication device is a radio.

16. The fire alarm communication device of claim 9 wherein said system trouble condition is an inability of the fire alarm communication device to establish communication with a network.

17. The fire alarm communication device of claim 9 wherein said system trouble condition is a condition that inhibits a communication between the fire alarm communication device and a central monitoring station.

* * * * *